US006344093B1

(12) United States Patent
Ohmori et al.

(10) Patent No.: US 6,344,093 B1
(45) Date of Patent: Feb. 5, 2002

(54) HIGH TENSILE STRENGTH STEEL PRODUCT FOR HIGH HEAT INPUT WELDING, HAVING EXCELLENT TOUGHNESS IN HEAT-AFFECTED ZONE

(75) Inventors: Akio Ohmori; Fumimaru Kawabata; Keniti Amano, all of Okayama (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/566,989

(22) Filed: May 9, 2000

(30) Foreign Application Priority Data

May 10, 1999 (JP) ..... 11-128100

(51) Int. Cl.[7] ..... C22C 38/14; C22C 38/12

(52) U.S. Cl. ..... 148/320; 148/330; 148/331; 420/84; 420/126; 420/127; 420/128

(58) Field of Search ..... 420/84, 126, 127, 420/128; 148/330, 320, 331

(56) References Cited

U.S. PATENT DOCUMENTS 4,629,504 A * 12/1986 Koike et al. ..... 420/38

* cited by examiner

*Primary Examiner*—Deborah Yee

(74) *Attorney, Agent, or Firm*—Young & Thompson

(57) ABSTRACT

A high tensile strength steel product for high heat input welding having excellent toughness in the heat-affected zone and having a tensile strength of at least 490 MPa contains, in terms of percent by weight, from about 0.05% to about 0.18% of C, 0.6% or less of Si, from about 0.80% to about 1.80% of Mn, 0.005% or less of Al, 0.030% or less of P, 0.004% or less of S, 0.005% or less of Nb, from about 0.04% to about 0.15% of V, from about 0.0050% to about 0.00150% of N, and from about 0.010% to about 0.050% of Ti, the ratio of the Ti content to the Al content, Ti/Al, satisfying 5.0 or more, and further contains at least one of from about 0.0010% to about 0.0100% of Ca and from about 0.0010% to about 0.0100% of REM, and the balance being Fe and incidental impurities. In the steel product, oxide inclusions containing, in terms of percent by weight, 20% to about 95% of a titanium oxide, 70% or less of $Al_2O_3$, 5% to about 50% in total of at least one of calcium oxide and a REM oxide, and 15% or less of MnO are dispersed.

19 Claims, 1 Drawing Sheet

FIGURE
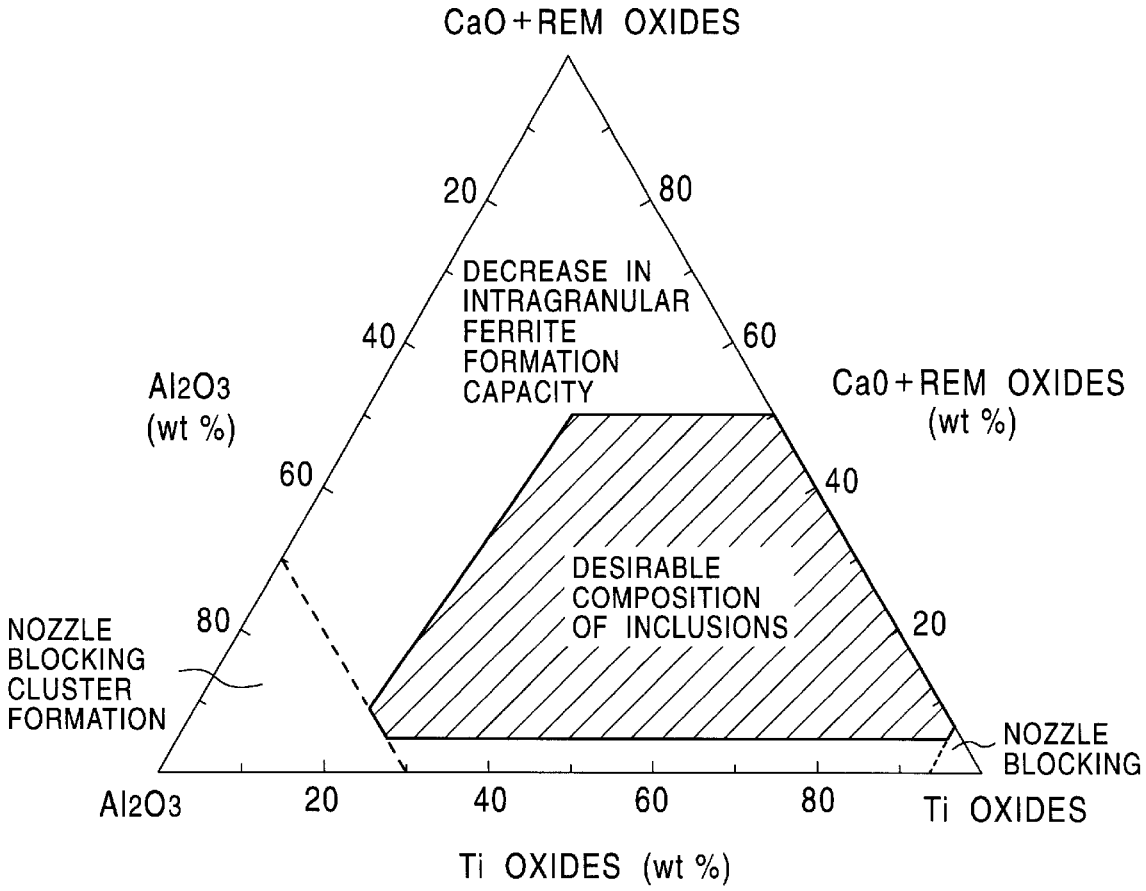

HIGH TENSILE STRENGTH STEEL PRODUCT FOR HIGH HEAT INPUT WELDING, HAVING EXCELLENT TOUGHNESS IN HEAT-AFFECTED ZONE

BACKGROUND OF THE INVENTION

1. Field of the Invention

The present invention relates to high tensile strength steels suitable for use in civil engineering, construction, bridges, marine structures, pipes, reservoirs, construction equipment, etc. More particularly, the invention relates to a high tensile strength steel product for high heat input welding having excellent toughness in the heat-affected zone, and preferably having a tensile strength of 490 MPa or more.

2. Description of the Related Art

Recently, as the size of structures has increased, thick steel products having high strength have been increasingly used. Moreover; in order to reduce construction costs, high heat input welding with a high weld efficiency has been employed. However, when the amount of heat input is increased, embrittlement in the weld zone may occur. Therefore, steel products suitable for high heat input welding, in which the toughness in the high heat input weld zone is improved, have been desired, and various proposals have been made.

For example, Japanese Unexamined Patent Application Publication No. 58-31065 discloses a technique for improving the heat-affected zone (HAZ) toughness by suppressing the coarsening of austenite grains using a nitride, for example, TiN. However, in certain zones, such as the weld bond zone, which are heated at high temperatures, the nitride, such as TiN, is dissolved and its capacity for suppressing grain coarsening is lost. Therefore, in the method in which nitride such as TiN is used, the toughness in the weld bond zone does not greatly improve, and, in particular, it is difficult to improve the toughness in the HAZ when it is subjected to very high heat input welding in which the heat input exceeds 80 kJ/mm.

Japanese Unexamined Patent Application Publication No. 60-245768 also discloses a method for improving the HAZ toughness by accelerating the precipitation of intragranular ferrite using titanium oxides or a complex of titanium oxides and titanium nitride. In accordance with this method, the grain coarsening can be suppressed by the pinning effect of the oxides which do not dissolve even at high temperatures. However, it takes advanced steelmaking techniques to disperse the titanium oxides homogeneously in steels, so that it is very difficult to produce such steel products stably and in large quantity. Additionally, since the melting points of the titanium oxides are as high as approximately 1,700° C. or more, nozzle clogging may readily occur due to the adhesion to the nozzle wall.

Japanese Unexamined Patent Application Publication No. 5-186848 also discloses a method for forming a HAZ having excellent toughness in which a compound precipitate of TiN—MnS—VN is dispersed in steels by adjusting the combined contents of C, V, and N with the addition of Ti, using the intragranular ferrite nucleation capacity of VN. However, since the effect of suppressing the coarsening of austenite grains by TiN is lost in very high heat input welding, the toughness in the HAZ which is subjected to very high heat input welding cannot be improved, and also the addition of MnS for accelerating the precipitation of VN decreases the cleanliness of steels and deteriorates the toughness of the base metal.

SUMMARY OF THE INVENTION

Accordingly, it is an object of the present invention to provide a high tensile strength steel product having excellent toughness in the high heat input weld zone, in which the toughness of the weld zone is not decreased even if high heat input welding with a heat input of more than 80 kJ/mm is performed.

The present inventors have made extensive efforts and carried out exhaustive research to develop a method of finely and homogeneously dispersing oxide inclusions, so as to refine austenite grains in the weld zone and to accelerate the precipitation of intragranular ferrite. As a result, it has been found that in order to finely and homogeneously disperse oxide inclusions which are effective in refining austenite grains and accelerating the precipitation of intragranular ferrite, the oxide inclusions must contain titanium oxides as a principal ingredient and the oxide inclusions must be within optimum compositional ranges.

Initially, the results of that research as regards the optimum ranges of the oxide inclusions will now be described.

First, in order to achieve a fine, homogeneous dispersion of oxide inclusions, satisfactory wettability is required between deoxidizing inclusions and molten steel, and for that purpose, the $Al_2O_3$ content in the total inclusion must be reduced to at most about 70% by weight.

Second, in order to accelerate the precipitation of intragranular ferrite, the titanium oxide content in the total oxide inclusion must be set to at least about 20% by weight; the MnO content in the total oxide inclusion must be at most about 15% by weight; and the content of CaO or a rare earth metal (REM) oxide in the total oxide inclusion must be at most about 50% by weight.

Third, in order to prevent nozzle blocking, the melting point of deoxidation products must be lowered, and for that purpose, the content of CaO or the REM oxide in the total inclusion must be at least about 5% by weight by Ca treatment or REM treatment; and also, the $Al_2O_3$ content and the titanium oxide content must be at most about 70% by weight and at most about 95% by weight, respectively.

Based on the findings described above, the optimum compositional ranges for the oxide inclusions have been determined by the present inventors. That is, as shown in FIG. 1, the Ti oxide content is in the range of from about 20% to about 95% by weight, the content of at least one of CaO and a REM oxide is in the range of from about 5% to about 50% by weight in total, and the $Al_2O_3$ content is at most about 70% by weight. Additionally, the MnO content is at most about 15%. By controlling the composition of the oxide inclusions in the ranges shown in FIG. 1, without causing nozzle clogging or the formation of harmful inclusion clusters, the intragranular ferrite formation capacity of the inclusions can be effectively used.

The present inventors have discovered that titanium oxides not only themselves act as sites for ferrite nucleation but also act as sites for precipitation of MnS and VN, which also possess intragranular ferrite formation capacity. The present inventors have also discovered that, in order to further accelerate the precipitation of intragranular ferrite, in addition to the fine, homogeneous dispersion of the oxide inclusions, incorporating V and N as ingredients of steel forms a compound precipitate, such as that which contains a titanium oxide and VN, and thus the intragranular ferrite formation capacity is significantly increased.

The present invention has been achieved based on the knowledge and discoveries described above.

That is, a high tensile strength steel product for high heat input welding having excellent toughness in the heat-affected zone and having a tensile strength of at least about 490 MPa, in accordance with the present invention, contains, in terms of percent by weight, from about 0.05% to about 0.18% C, at most about 0.6% Si, from about 0.80% to about 1.80% Mn, at most about 0.005% Al, at most about 0.030% P, at most about 0.004% S, at most about 0.005% Nb, from about 0.04% to about 0.15% V, from about 0.0050% to about 0.00150% N, and from about 0.010% to about 0.050% Ti, the ratio of the Ti content to the Al content (Ti/Al) being at least about 5.0; and further contains at least one of (a) from about 0.0010% to about 0.0100% of Ca and (b) from about 0.0010% to about 0.0100% of REM, balance Fe and incidental impurities. In the steel product, oxide inclusions are dispersed, which contain, in terms of percent by weight, from about 20% to about 95% titanium oxide, at most about 70% $Al_2O_3$, from about 5% to about 50% in total of at least one of calcium oxide and a REM oxide, and at most about 15% MnO.

Preferably, the steel product further contains, in terms of percent by weight, at least one of the following ingredients, in the following amounts: from about 0.05% to about 1.0% Cu, from about 0.05% to about 0.50% Ni, from about 0.05% to about 0.50% Cr, and from about 0.02% to about 0.20% Mo. Preferably, the steel product further contains, in terms of percent by weight, from about 0.0005% to about 0.0030% B.

BRIEF DESCRIPTION OF THE DRAWINGS

FIG. 1 is a ternary phase diagram which shows the desirable compositional ranges of oxide inclusions.

DESCRIPTION OF THE PREFERRED EMBODIMENT

First, the reasons for specifying the ranges in chemical compositions of a steel product in accordance with the present invention will be described. Hereinafter, percentages refer to percent by weight (wt %) unless otherwise specified.

C: from about 0.05% to about 0.18%

Carbon increases the strength of steels and the carbon content should be 0.05% or more in order to secure the desired strength. If the content exceeds about 0.18%, the base metal toughness and the HAZ toughness are decreased. Therefore, the carbon content is limited in the range of from about 0.05% to about 0.18%, and preferably, 0.08% to about 0.16%.

Si: at most about 0.6%

Although silicon is effective in increasing the strength of steels by solid-solution strengthening, a content exceeding about 0.6% significantly deteriorates weldability and the HAZ toughness. Therefore, the silicon content is limited to at most about 0.6%.

Mn: from about 0.80% to about 1.80%

Manganese increases the strength of steels and the manganese content should be about 0.80% or more to secure the desired strength. However, if the manganese content exceeds about 1.80%, the steel structure containing ferrite and pearlite is transformed into a structure mainly composed of low-temperature transforming products such as bainite, and thereby the base metal toughness is decreased. Therefore, the manganese content is limited in the range of about 0.80% to about 1.80%, and preferably, 1.00% to 1.70%.

Al: at most about 0.005%

Aluminum acts as a deoxidizer and can be used as a preliminary deoxidizer to adjust the O concentration before Ti deoxidation is performed in the present invention. However, if a large amount of aluminum is added, the $Al_2O_3$ concentration in the total inclusion is increased, and thereby large cluster inclusions may be formed, or nozzle clogging may be caused. Therefore, the aluminum content is about 0.005% or less.

P: at most about 0.030%

Since phosphorus deteriorates the base metal toughness and the HAZ toughness, it is desirable that the phosphorus content be reduced as much as possible. The phosphorus content is limited to at most about 0.030%, and preferably, 0.020% or less.

S: at most about 0.004%

Sulfur accelerates the precipitation of VN by forming MnS and accelerates the formation of intragranular ferrite to refine ferrite grains. However, sulfur segregates in austenite grain boundaries or forms MnS in grain boundaries, and thereby surface cracks of cast slabs easily occur. An increase in the sulfur content deteriorates the cleanness of steels and deteriorates the base metal toughness and the HAZ toughness. Therefore, the sulfur content is limited to about 0.004% or less.

Nb: at most about 0.005%

Niobium improves the hardenability of steels by being dissolved and it suppresses the formation of intragranular ferrite. Niobium also easily combines with nitrogen to form nitrides, and thereby the amount of the formation of VN which acts as a nucleus for forming ferrite is decreased. If the niobium content exceeds about 0.005%, the effect of the intragranular ferrite formation by VN is not achieved. Therefore, the niobium content is limited to about 0.005% or less.

V: from about 0.04% to about 0.15%

Vanadium is an important element in the present invention and combines with nitrogen to form vanadium nitride (VN), which is precipitated in austenite during cooling. The vanadium nitride acts as a nucleus for forming intragranular ferrite, refines ferrite grains, and improves the toughness. Although such effects are demonstrated when the vanadium content is at least about 0.04%, if the content exceeds about 0.15%, the base metal toughness, the HAZ toughness, and the weldability deteriorate. Therefore, the vanadium content is limited in the range of from about 0.04% to about 0.15%, and preferably, 0.05% to 0.10%.

N: from about 0.005% to about 0.0150%

Nitrogen combines with vanadium and/or titanium to form nitrides. The nitrides suppress the growth of austenite grains during heating and also act as nuclei for forming intragranular ferrite, refine ferrite grains, and improve the toughness. In order to effectively exert such effects, the nitrogen content should be about 0.005% or more. If the content exceeds about 0.0150%, the base metal toughness and weldability are greatly impaired due to an increase in dissolved N. Therefore, the nitrogen content is limited in the range of from about 0.005% to about 0.0150%, and preferably, 0.0070% to 0.0120%.

Ti: from about 0.010% to about 0.050%

Titanium is an important element in the present invention. The most important feature of the present invention is that Ti deoxidation is performed and oxides formed by the Ti deoxidation are effectively used. Titanium oxides dispersed in steels suppress the growth of austenite grains and accelerate the precipitation of intragranular ferrite. The titanium remaining in steels after deoxidation forms TiN in the subsequent cooling process. TiN contributes to suppressing the coarsening of austenite grains in the HAZ, and improves the HAZ toughness. In order to achieve such effects, the titanium content should be about 0.010% or more. If the content exceeds about 0.050%, dissolved Ti increases or Ti carbides are precipitated, thereby deteriorating the base metal toughness and the HAZ toughness. Therefore, the titanium content is limited in the range of about 0.010% to about 0.050%.

Ti/Al: at least about 5.0

In the present invention, the ratio Ti/Al is at least about 5.0 in order to perform Ti deoxidation and to avoid the formation of $Al_2O_3$ clusters. From the Ti—Al—O equilibrium to the ratio Ti/Al at less than 5.0, $Al_2O_3$ clusters are formed, and it is not possible to finely and homogeneously disperse oxide inclusions. Preferably, the ratio Ti/Al is set at 10.0 or more.

Ca: from about 0.0010% to about 0.010% and/or REM: from about 0.0010 to about 0.010%

Ca and REM contribute to decreasing the melting points of inclusions and to improving wettability, and are elements essential to attain the fine, homogeneous dispersion of deoxidation products. For that purpose, the content of each element should be about 0.0010% or more. However, if the content of each element exceeds about 0.010%, the cleanness of steels deteriorates and the base metal toughness is impaired. Therefore, the content of each of Ca and REM is limited in the range of about 0.0010% to about 0.010%.

Cu: from about 0.05% to about 1.0%, Ni: from about 0.05% to about 0.50%, Cr: from about 0.05% to about 0.50%, and/or Mo: from about 0.02% to about 0.20%

Copper, nickel, chromium, and molybdenum are elements which are effective in improving hardenability and may be incorporated as required in order to increase the strength of steels. In order to exert the strength-increasing effect, the content of each of Cu, Ni, and Cr must be 0.05% or more, and the Mo content must be 0.02% or more. However, with respect to Cu and Ni, if the content exceeds 1.0 and 0.50%, the effect is saturated, the effect measured up to the content cannot be expected, thus being uneconomical. Therefore, the content of each of Cu and Ni is limited in the range of from about 0.05% to about 1.0 and 0.50%. If the Cr content and the Mo content exceed 0.50% and 0.20%, respectively, the weldability and the toughness deteriorate. Therefore, preferably, the Cr content is limited in the range of from about 0.05% to about 0.50% and the Mo content is limited in the range of from about 0.02% to about 0.20%.

B: from about 0.0005% to about 0.0030%

Boron segregates in austenite grain boundaries and suppresses the formation of coarse intergranular ferrite that deteriorates the toughness, and also forms BN in the HAZ during cooling after welding, and accelerates the formation of intragranular ferrite. Boron may be incorporated as required. In the case of small heat input welding having a relatively fast cooling rate, because of insufficient time for the precipitation of VN, intragranular ferrite is insufficiently formed by VN. However, since BN can be precipitated for a shorter period of time in comparison with VN, the effect of accelerating the intragranular ferrite formation is achieved, in particular, under the small heat input welding conditions in which VN is insufficiently precipitated. In order to exert such an effect, the boron content must be 0.0005% or more. If the content exceeds 0.0030%, the toughness deteriorates. Therefore, preferably, the boron content is limited in the range of from about 0.0005% to about 0.0030%.

The balance, other than the ingredients described above, corresponds to Fe and incidental impurities. As the incidental impurities, 0.010% or less of O is acceptable.

In the present invention, as inclusions (oxide inclusions) finely dispersed in steel products, in terms of percent by weight, 20% to about 95% of a titanium oxide, 70% or less of $Al_2O_3$, 5% to about 50% in total of at least one of calcium oxide and a REM oxide, and 15% or less of MnO are incorporated.

Titanium oxides: 20% to about 95%

Titanium oxides act as sites for ferrite nucleation, and also act as sites for precipitation of MnS, VN, etc. which have intragranular ferrite formation capacity. Therefore, in the present invention, the oxide inclusions contain titanium oxides as a principal ingredient. In order to accelerate the precipitation of intragranular ferrite, the titanium oxide content in the total oxide inclusion must be 20% or more. If the content is less than 20%, the precipitation of intragranular ferrite is not accelerated. If the titanium oxide content in the total oxide inclusion exceeds 95%, the melting points of the oxide inclusions are increased, and the inclusions easily adhere to the dipping nozzle wall, resulting in nozzle blocking. Therefore, the titanium oxide content in the total oxide inclusion is limited in the range 20% to about 95%, and preferably, 50% to about 95%. In the present invention, examples of titanium oxides preferably include $TiO_2$, $Ti_2O_3$, etc.

$Al_2O_3$: 70% or less $Al_2O_3$ easily forms large cluster inclusions, and inhibits the homogeneous, fine dispersion of the oxide inclusions. Therefore, in the present invention, the $Al_2O_3$ content in the total oxide inclusion is desirably reduced as much as possible. If the $Al_2O_3$ content in the total oxide inclusion exceeds 70%, the wettability between the inclusions and molten steel is decreased, and nozzle blocking is easily caused. Therefore, the $Al_2O_3$ content in the total oxide inclusion is set at 70% or less.

Calcium oxide and/or REM oxides: 5% to about 50% in total

In the present invention, in order to decrease the melting points of oxide inclusions, 5% or more in total of at least one of calcium oxide (CaO) and a REM oxide is incorporated in the oxide inclusions. Since Ca and REM easily combine with S to form sulfides, if the content of calcium oxide (CaO) and the REM oxide in the total oxide inclusion exceeds 50%, CaS and a REM sulfide are formed around the inclusions. Thereby, the inclusions are coarsened, and the capacity for accelerating the precipitation of intragranular ferrite by the oxide inclusions is degraded. Therefore, the content of at least one of calcium oxide and the REM oxide in the total oxide inclusion is limited in the range of 5% to about 50% in total.

MnO: 15% or less

MnO degrades the capacity for accelerating the precipitation of intragranular ferrite by titanium oxides. Therefore, the MnO content in the total oxide inclusion is limited to about 15% or less.

In the steel product of the present invention, the content of the total oxide inclusion is preferably set at from about 0.005% to about 0.025% by weight. The sizes of the oxide inclusions are preferably set at 3 $\mu$m or less. If the sizes exceed 3 $\mu$m, the capacity for suppressing austenite grain coarsening and the capacity for accelerating the precipitation of intragranular ferrite are degraded.

In the present invention, the amount of inclusions is measured by the cleanness test using an optical microscope, or by the assay of extracted residues. The composition of the inclusions is measured by the quantitative analysis by EDX using a scanning electron microscope (SEM).

Next, a method of making a steel product of the present invention will be described.

Molten steel having the composition described above is prepared by performing Ti deoxidation. Of course, preliminary deoxidation by Al may be performed. Any known method using a converter, an electric furnace, a vacuum melting furnace, or the like may be advantageously employed. Additionally, by selecting the Ti deoxidation, in the deoxidation products will be inclusions mainly composed of titanium oxides. Preferably, the composition of the deoxidation products is adjusted by the amounts of alloy elements added and the procedure of preliminary deoxidation.

The molten steel is then cast into a material to be rolled, such as a slab, by advantageously employing any known casting method, such as continuous casting or ingot casting.

The material to be rolled is subjected to hot rolling with or without being reheated at 1,000° C. to 1,250° C. to produce a thick steel sheet. In the present invention, hot-rolling conditions and cooling after hot-rolling are not specifically limited.

EXAMPLES

Each of the steels having the composition shown in Table 1 was melted in a vacuum melting furnace. The composition of oxide inclusions was adjusted mainly by changing the Ti/Al balance and the amounts of addition of Ca and REM. The molten steel was injected into a mold from a ladle using a nozzle to produce a steel ingot. With respect to the adhesion of inclusions in the nozzle during casting, the interior of the nozzle was visually examined after casting to check about the existence of the inclusions.

Comparative examples with the compositions of oxide inclusions being out of the range of the present invention were prepared, in which in order to increase the titanium oxide content, Al deoxidation was not performed and the ratio Ti/Al was increased; in order to increase the contents of CaO and a REM oxide, the amount of Ca or REM added was increased; in order to increase the $Al_2O_3$ content, preliminary deoxidation by Al was sufficiently performed; and in order to increase the MnO content, preliminary deoxidation by Mn was performed and the amounts of addition of Al, Ti, and Ca were decreased.

The steel ingots obtained were subjected to blooming to produce slabs having a thickness of 100 mm. The slabs were then heated at 1,200° C. and subjected to hot-rolling to produce steel sheets having a thickness of 20 mm. Air-cooling was performed after hot-rolling.

Using the products as hot-rolled, tensile characteristics and Charpy impact toughness were evaluated with respect to base metals. Specimens were taken from the products as hot-rolled and in order to evaluate HAZ toughness (synthetic HAZ toughness), after heat cycles equivalent to heat inputs of 5 kJ/mm and 100 kJ/mm corresponding to the electroslag welding joint bond zone were applied at a maximum heating temperature of 1,400° C., Charpy absorbed energy ($vE_{-20}$) at −20° C. was obtained. The average cooling time from 800° C. to 500° C. was set at 25 sec and 1,000 sec, respectively. Specimens were also taken from the products as hot-rolled and the compositions of oxide inclusions in the steel products were evaluated. The quantitative analysis by EDX using a SEM, as described above, was used in order to analyze the compositions.

The evaluation results are shown in Table 2.

In the examples of the present invention, Steel Products Nos. 1 to 13 had high strength and high toughness with a tensile strength TS of 490 MPa or more and a fracture appearance transition temperature vTrs of −30° C. or less with respect to the base metals. In the examples of the present invention, with respect to the synthetic HAZ equivalent to heat inputs of 5 kJ/mm and 100 kJ/mm, high toughness was exhibited with a Charpy absorbed energy ($vE_{-20}$) of 40 J or more at a testing temperature of −20° C.

In contrast, in the comparative examples, the HAZ toughness was decreased. In Steel Product Nos. 17 and 18, since the compositions of inclusions were out of the range of the present invention, the synthetic HAZ corresponding to the very high heat input welding joint bond zone with 100 kJ/mm had a low Charpy absorbed energy ($vE_{-20}$) of 30 J or less. In Steel Product No. 19, because of the Nb content exceeding the higher limit of the present invention, and in Steel Product No. 20, because of the titanium content lower than the range specified in the present invention, the Charpy absorbed energy ($vE_{-20}$) in the synthetic HAZ was decreased. In the Steel Nos. 14, 15, 16, and 18, since the compositions of inclusions were out of the range of the present invention, inclusions were adhered to the interior of the nozzle.

As described above, in accordance with the present invention, a high tensile strength steel product having excellent toughness in the high heat input weld zone and having a tensile strength of 490 MPa or more can be easily produced industrially, and significant industrial advantages are attained.

TABLE 1

| Steel | Chemical composition (wt %) | | | | | | | | | |
|---|---|---|---|---|---|---|---|---|---|---|
| No. | C | Si | Mn | P | S | Al | Cu | Ni | Cr | Mo |
| A | 0.14 | 0.31 | 1.35 | 0.012 | 0.0016 | 0.003 | — | — | — | — |
| B | 0.14 | 0.23 | 1.38 | 0.014 | 0.0015 | 0.003 | — | — | — | — |
| C | 0.13 | 0.25 | 1.41 | 0.011 | 0.0009 | 0.003 | 0.32 | — | — | — |
| D | 0.13 | 0.30 | 1.32 | 0.010 | 0.0028 | 0.004 | 0.55 | 0.25 | — | — |
| E | 0.12 | 0.10 | 1.25 | 0.014 | 0.0033 | 0.005 | — | — | 0.26 | — |
| F | 0.12 | 0.22 | 1.38 | 0.015 | 0.0018 | 0.002 | — | — | — | 0.12 |
| G | 0.12 | 0.20 | 1.45 | 0.009 | 0.0025 | 0.003 | — | 0.41 | — | — |
| H | 0.12 | 0.25 | 1.36 | 0.013 | 0.0031 | 0.002 | 0.25 | 0.12 | 0.15 | |
| I | 0.13 | 0.24 | 1.47 | 0.017 | 0.0010 | 0.003 | — | — | — | — |
| J | 0.14 | 0.15 | 1.38 | 0.012 | 0.0022 | 0.001 | 0.30 | — | — | — |
| K | 0.13 | 0.20 | 1.42 | 0.016 | 0.0013 | 0.002 | — | 0.28 | — | — |
| L | 0.11 | 0.03 | 1.22 | 0.015 | 0.0011 | 0.002 | — | — | 0.37 | — |
| M | 0.12 | 0.32 | 1.24 | 0.014 | 0.0024 | 0.003 | — | — | — | 0.18 |
| N | 0.14 | 0.33 | 1.33 | 0.012 | 0.0020 | 0.003 | — | — | — | — |
| O | 0.13 | 0.21 | 1.38 | 0.011 | 0.0013 | 0.002 | 0.13 | 0.08 | — | — |

TABLE 1-continued

| | | | | | | | | | | |
|---|---|---|---|---|---|---|---|---|---|---|
| P | 0.14 | 0.25 | 1.37 | 0.019 | 0.0029 | 0.001 | — | — | — | — |
| Q | 0.13 | 0.20 | 1.24 | 0.017 | 0.0019 | 0.002 | — | — | 0.21 | — |
| R | 0.13 | 0.24 | 1.30 | 0.012 | 0.0024 | 0.001 | — | — | — | 0.12 |
| S | 0.12 | 0.31 | 1.45 | 0.011 | 0.0018 | 0.003 | 0.24 | 0.12 | — | — |
| T | 0.13 | 0.21 | 1.25 | 0.011 | 0.0027 | 0.001 | — | 0.11 | 0.05 | 0.05 |
| U | 0.14 | 0.34 | 1.34 | 0.012 | 0.0023 | 0.003 | 0.15 | 0.13 | — | — |

| Steel | Chemical composition (wt %) | | | | | | | | | |
|---|---|---|---|---|---|---|---|---|---|---|
| No. | V | Nb | N | B | Ti | Ca | REM | O | Ceq | Ti/Al |
| A | 0.066 | 0.001 | 0.0088 | 0.0002 | 0.025 | 0.0018 | — | 0.0026 | 0.383 | 8.3 |
| B | 0.064 | 0.001 | 0.0071 | 0.0002 | 0.022 | — | 0.0026 | 0.0037 | 0.384 | 7.3 |
| C | 0.068 | 0.001 | 0.0086 | 0.0002 | 0.018 | 0.0020 | 0.0016 | 0.0021 | 0.380 | 6.0 |
| D | 0.082 | 0.002 | 0.0117 | 0.0001 | 0.026 | 0.0017 | — | 0.0039 | 0.375 | 6.5 |
| E | 0.051 | 0.001 | 0.0092 | 0.0001 | 0.033 | 0.0025 | — | 0.0027 | 0.388 | 6.6 |
| F | 0.072 | 0.001 | 0.0076 | 0.0003 | 0.021 | 0.0032 | — | 0.0031 | 0.394 | 10.5 |
| G | 0.074 | 0.002 | 0.0088 | 0.0002 | 0.023 | 0.0015 | — | 0.0029 | 0.386 | 7.7 |
| H | 0.060 | 0.003 | 0.0076 | 0.0001 | 0.037 | — | 0.0056 | 0.0020 | 0.394 | 18.5 |
| I | 0.052 | 0.001 | 0.0083 | 0.0008 | 0.021 | 0.0021 | — | 0.0041 | 0.389 | 7.0 |
| J | 0.061 | 0.002 | 0.0096 | 0.0012 | 0.012 | — | 0.0028 | 0.0037 | 0.381 | 12.0 |
| K | 0.059 | 0.001 | 0.0095 | 0.0015 | 0.027 | 0.0023 | — | 0.0038 | 0.386 | 13.5 |
| L | 0.060 | 0.001 | 0.0097 | 0.0007 | 0.028 | 0.0024 | 0.0011 | 0.0040 | 0.393 | 14.0 |
| M | 0.058 | 0.001 | 0.0092 | 0.0011 | 0.024 | 0.0014 | — | 0.0028 | 0.389 | 8.0 |
| N | 0.068 | 0.001 | 0.0103 | 0.0001 | 0.048 | 0.0010 | — | 0.0033 | 0.380 | 16.0 |
| O | 0.061 | 0.001 | 0.0097 | 0.0001 | 0.026 | 0.0002 | — | 0.0028 | 0.375 | 13.0 |
| P | 0.066 | 0.001 | 0.0082 | 0.0002 | 0.023 | 0.0016 | — | 0.0019 | 0.383 | 23.0 |
| Q | 0.055 | 0.001 | 0.0088 | 0.0001 | 0.020 | 0.0035 | 0.0022 | 0.0028 | 0.391 | 10.0 |
| R | 0.063 | 0.002 | 0.0085 | 0.0003 | 0.012 | 0.0012 | — | 0.0024 | 0.391 | 12.0 |
| S | 0.065 | 0.010 | 0.0080 | 0.0002 | 0.022 | 0.0032 | — | 0.0020 | 0.382 | 7.3 |
| T | 0.058 | 0.002 | 0.0078 | 0.0002 | 0.008 | 0.0013 | 0.0018 | 0.0027 | 0.376 | 8.0 |
| U | 0.032 | 0.001 | 0.0045 | 0.0002 | 0.024 | 0.0015 | — | 0.0031 | 0.383 | 8.0 |

TABLE 2

| Steel product No. | Steel No. | Inclusion composition: Ti Oxides** | CaO + REM Oxides** | $Al_2O_3$** | MnO, etc.** | Total (wt %) | Adhesion of inclusion in nozzle | Base metal characteristics: YS (MPA) | TS (MPA) | vTrs (° C.) | $vE_{-20}$ (J) | Synthetic HAZ toughness: 5 kJ/mm equivalent $vE_{-20}$ (J) | 100 kJ/mm equivalent $vE_{-20}$ (J) | Remarks |
|---|---|---|---|---|---|---|---|---|---|---|---|---|---|---|
| 1 | A | 70 | 10 | 15 | 5 | 0.008 | Not observed | 365 | 523 | −36 | 217 | 102 | 68 | Example of the present invention |
| 2 | B | 65 | 10 | 20 | 5 | 0.014 | Not observed | 364 | 521 | −35 | 222 | 108 | 67 | |
| 3 | C | 55 | 25 | 17 | 3 | 0.009 | Not observed | 370 | 534 | −38 | 230 | 100 | 73 | |
| 4 | D | 60 | 20 | 16 | 4 | 0.012 | Not observed | 372 | 538 | −40 | 244 | 124 | 81 | |
| 5 | E | 60 | 20 | 17 | 3 | 0.009 | Not observed | 370 | 540 | −35 | 220 | 102 | 66 | |
| 6 | F | 75 | 15 | 8 | 2 | 0.010 | Not observed | 375 | 542 | −37 | 236 | 135 | 89 | |
| 7 | G | 70 | 15 | 11 | 4 | 0.009 | Not observed | 372 | 542 | −36 | 222 | 119 | 72 | |
| 8 | H | 80 | 15 | 2 | 3 | 0.010 | Not observed | 386 | 559 | −35 | 227 | 144 | 98 | |
| 9 | I | 60 | 20 | 16 | 4 | 0.013 | Not observed | 366 | 524 | −38 | 236 | 110 | 70 | |
| 10 | J | 70 | 15 | 11 | 4 | 0.015 | Not observed | 377 | 532 | −36 | 230 | 149 | 84 | |
| 11 | K | 75 | 15 | 7 | 3 | 0.012 | Not observed | 371 | 528 | −45 | 251 | 180 | 94 | |
| 12 | L | 75 | 15 | 8 | 2 | 0.017 | Not observed | 375 | 530 | −40 | 249 | 158 | 98 | |
| 13 | M | 65 | 10 | 21 | 4 | 0.009 | Not observed | 388 | 555 | −35 | 221 | 101 | 65 | Comparative example |
| 14 | N | 97 | 2 | 1 | 0 | 0.010 | Observed | 363 | 529 | −35 | 220 | 127 | 65 | |
| 15 | O | 98 | 0 | 2 | 0 | 0.008 | Observed | 370 | 535 | −35 | 223 | 130 | 71 | |
| 16 | P | 15 | 3 | 80 | 2 | 0.004 | Observed | 366 | 532 | −38 | 234 | 95 | 23 | |

TABLE 2-continued

| Steel product No. | Steel No. | Inclusion composition: Ti Oxides** | CaO + REM Oxides** | $Al_2O_3$** | MnO, etc.** | Total (wt %) | Adhesion of inclusion in nozzle | Base metal characteristics: YS (MPA) | TS (MPA) | vTrs (° C.) | $vE_{-20}$ (J) | Synthetic HAZ toughness: 5 kJ/mm equivalent $vE_{-20}$ (J) | 100 kJ/mm equivalent $vE_{-20}$ (J) | Remarks |
|---|---|---|---|---|---|---|---|---|---|---|---|---|---|---|
| 17 | Q | 5 | 75 | 19 | 1 | 0.013 | Not observed | 375 | 538 | −40 | 240 | 108 | 25 | |
| 18 | R | 30 | 5 | 45 | 20 | 0.007 | Observed | 377 | 538 | −46 | 241 | 92 | 19 | |
| 19 | S | 65 | 20 | 10 | 5 | 0.007 | Not observed | 388 | 535 | −19 | 182 | 46 | 12 | |
| 20 | T | 68 | 20 | 10 | 2 | 0.011 | Not observed | 367 | 530 | −33 | 216 | 42 | 16 | |
| 21 | U | 70 | 20 | 7 | 3 | 0.009 | Not observed | 355 | 525 | −15 | 165 | 67 | 15 | |

**wt % (content in total inclusion)

What is claimed is:

1. A high tensile strength steel product for high heat input welding having excellent toughness in the heat-affected zone and having a tensile strength of at least about 490 MPa, said steel product comprising, in terms of percent by weight:

from about 0.05% to about 0.18% C;

at most about 0.6% Si;

from about 0.80% to about 1.80% Mn;

at most about 0.005% Al;

at most about 0.030% P;

at most about 0.004% S;

at most about 0.005% Nb;

from about 0.04% to about 0.15% of V;

from about 0.0050% to about 0.0150% of N;

from about 0.010% to about 0.050% of Ti, the ratio of Ti to Al being at least about 5.0;

at least one of (a) from about 0.0010% to about 0.0100% of Ca and (b) from about 0.0010% to about 0.0100% of REM; and balance Fe and incidental impurities; and dispersed oxide inclusions, the oxide inclusions comprising, in terms of percent by weight, from about 20% to about 95% of titanium oxide, at most about 70% $Al_2O_3$, from about 5% to about 50% in total of at least one of calcium oxide and a REM oxide, and at most about 15% MnO; and wherein the V, Ti and N form at least one of VN and TiN.

2. The high tensile strength steel product for high heat input welding according to claim 1, further comprising, in terms of percent by weight, at least one of the following ingredients in the following amounts: from about 0.05% to about 1.0% of Cu, from about 0.05% to about 0.50% of Ni, from about 0.05% to about 0.50% of Cr, and from about 0.02% to about 0.20% of Mo.

3. The high tensile strength steel product for high heat input welding according to claim 1, further comprising, in terms of percent by weight, from about 0.0005% to about 0.0030% of B.

4. The high tensile strength steel product for high heat input welding according to claim 2, further comprising, in terms of percent by weight, from about 0.0005% to about 0.0030% of B.

5. The high tensile strength steel product for high heat input welding according to claim 1, wherein the steel product is a thick steel sheet.

6. The high tensile strength steel product for high heat input welding according to claim 2, wherein the steel product is a thick steel sheet.

7. The high tensile strength steel product for high heat input welding according to claim 3, wherein the steel product is a thick steel sheet.

8. The high tensile strength steel product for high heat input welding according to claim 4, wherein the steel product is a thick steel sheet.

9. The high tensile strength steel product for high heat input welding according to claim 1, wherein the steel product is an H-shaped steel.

10. The high tensile strength steel product for high heat input welding according to claim 2, wherein the steel product is An H-shaped steel.

11. The high tensile strength steel product for high heat input welding according to claim 3, wherein the steel product is an H-shaped steel.

12. The high tensile strength steel product for high heat input welding according to claim 4, wherein the steel product is an H-shaped steel.

13. The high tensil strength steel product for high heat input welding according to claim 1, wherein the ratio of Ti to Al is at least about 10.0.

14. The high tensile strength steel product for high heat input welding according to claim 1, wherein the V content is 0.05–0.10%.

15. The high tensile strength steel product for high heat input welding according to claim 1, wherein the C content is 0.08–0.16%.

16. The high tensile strength steel product for high heat input welding according to claim 1, wherein the Mn content is 1.00–1.70%.

17. The high tensile strength steel product for high heat input welding according to claim 1, wherein the P content is at most about 0.020%.

18. The high tensile strength steel product for high heat input welding according to claim 1, wherein the N content is 0.0070–0.0120%.

19. The high tensile strength steel product for high heat input welding according to claim 1, wherein the oxide inclusions comprise from about 50% to about 95% titanium oxide.

* * * * *